United States Patent [19]

Pischinger et al.

[11] Patent Number: 4,700,684

[45] Date of Patent: Oct. 20, 1987

[54] METHOD OF CONTROLLING RECIPROCATING FOUR-STROKE INTERNAL COMBUSTION ENGINES

[75] Inventors: Franz Pischinger; Peter Kreuter, both of Aachen, Fed. Rep. of Germany

[73] Assignee: FEV Forschungsgesellschaft für Energietechnik und Verbrennungsmotoren mbH, Aachen, Fed. Rep. of Germany

[21] Appl. No.: 576,896

[22] Filed: Feb. 3, 1984

[30] Foreign Application Priority Data

Feb. 4, 1983 [DE] Fed. Rep. of Germany ..... 3303725

[51] Int. Cl.[4] ..... F02M 25/06

[52] U.S. Cl. ..... 123/568; 123/90.11; 123/90.16; 123/348

[58] Field of Search ..... 123/90.11, 90.15, 90.16, 123/90.17, 90.6, 316, 320, 321, 322, 345, 346, 347, 348, 437, 440, 198 F, 568

[56] References Cited

U.S. PATENT DOCUMENTS

| | | | |
|---|---|---|---|
| 1,082,004 | 12/1913 | Anthony | 123/348 |
| 2,528,983 | 11/1950 | Weiss | 123/346 X |
| 2,670,595 | 3/1954 | Miller | 123/90.16 X |
| 2,997,991 | 8/1961 | Roan | 123/90.16 |
| 3,166,057 | 1/1965 | Konrad et al. | 123/90.16 |
| 3,547,087 | 12/1970 | Siegler | 123/321 |
| 4,327,676 | 5/1982 | McIntire et al. | 123/90.6 |
| 4,357,917 | 11/1982 | Aoyama | 123/568 X |
| 4,373,187 | 2/1983 | Ishii et al. | 123/440 X |
| 4,378,003 | 3/1983 | Imamura | 123/568 |
| 4,392,459 | 7/1983 | Chareire | 123/90.11 X |

FOREIGN PATENT DOCUMENTS

| | | | |
|---|---|---|---|
| 0357802 | 3/1938 | Italy | 123/316 |

*Primary Examiner*—Willis R. Wolfe, Jr.

*Attorney, Agent, or Firm*—Watson, Cole, Grindle & Watson

[57] ABSTRACT

The present invention relates to a method for unthrottled load control of an internal combustion engine by means of exhaust gas. The method requires entirely freely adjustable opening and closing times for the inlet and exhaust valves. Starting at full load with the minimum of exhaust gas in the cylinder the amount of exhaust gas in the cylinder is increased thereby reducing the available combustion chamber volume for receiving fresh mixture mass thereby reducing the load. The fresh mixture mass and the exhaust gas mass are controlled exclusively by coordinating the opening and closing times of the intake and exhaust valves.

10 Claims, 20 Drawing Figures

METHOD OF CONTROLLING RECIPROCATING FOUR-STROKE INTERNAL COMBUSTION ENGINES

BACKGROUND OF THE INVENTION

1. Field of the Invention:

This invention generally concerns a method for controlling an internal combustion four-stroke engine and more particularly concerns a method for independently controlling combustion chamber inlet and outlet devices by variable synchronization of the opening and closing duration times of the inlet and outlet devices.

2. Description of the Prior Art:

Adaptable control of the inflow and outflow of the work medium in internal combustion engines is desired in order to optimally influence the combustion process according to any operating conditions associated with such engines. Such adaptable or variable control is particularly desirable in intermittent internal combustion engines, as such engines operate under widely varying operating conditions.

Camshafts usually are used to control the gas shuttle valves, slide valves, etc. in internal combustion engines. Systems of this type have the disadvantage that they have little or no influence on the opening and closing valve timing durations.

According to the present state of the art, in reciprocating piston internal combustion engines such as Otto engines in which the fuel-air mixing ratio must be maintained within certain narrow limits, the engine load must be controlled by controlling the amount of fresh air and fuel mixture in the work chamber. The usually invariable valve duration control times which result from the cam shape of a camshaft necessitates the amount of fresh air and fuel mixture to be controlled by throttling the inlet system. This throttling produces gas exchange losses and unfavorable amounts of residual gas in the cylinder charge.

It has been suggested that the disadvantages of throttling can be avoided by varying the control timing of the inlet opening. Thus, for example, SAE paper 770,880 by Sherman and Blumberg suggests that an engine load control can be achieved by metering the air-fuel charge into the work chamber with a variable inlet control time. This adaptation of the inlet control constitutes an improvement over an inflexible inlet control, because the usual throttle device and the losses associated with it can be eliminated. However, such type of load control also entails disadvantages. Specifically, as the load decreases, the effective compression ratio drops and the compression temperature decreases. This causes the ignitability of the mixture and the quality of the combustion to drop. Thus, the advantages of eliminating throttle losses are partially or entirely cancelled out in the instance of an engine under partial load.

SUMMARY OF THE INVENTION

The present invention has the object of utilizing the advantages of an unthrottled metering control of the air-fuel charge while avoiding the above-noted disadvantages. This object is achieved in accordance with the present invention by a method for controlling reciprocating piston internal combustion engines. The engine load is controlled by controlling the amount of fresh air and fuel mixture in the combustion chamber with a variable amount of exhaust gas in the cylinder charge.

The amount of fresh air and fuel mixture is exclusively controlled with independent inlet and outlet devices each associated with respective flow area dimensions section in the intake and exhaust gas system which are invariable outside of the inlet and outlet devices. Such control is exclusively realized by coordinating the opening and closing times of the inlet and outlet devices. A certain amount of exhaust gas is maintained in the cylinder after the end of the gas exchange, which reduces the remaining cylinder volume for receiving the fresh air and fuel mixture in order to control the engine load, such that the exhaust gas and fresh air and fuel mixture are mixed in the cylinder during the filling intake and compressing process.

The control of the outlet device, normally the outlet valve, is used not only to control the outlet exhaust process as was previously customary in reciprocating piston internal combustion engines, but is also used to a significant extent to control the amount of fresh air and fuel charge admitted to the cylinder.

The objects initially described can be fully met by controlling not only the inlet valve to obtain optimum engine performance but also by controlling the outlet valve in a combined and coordinated manner together with the inlet valve in all operating states to control the charge exchange. In particular, an optimum control of the engine is possible under all engine load demands which occur during normal engine operation.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENT

Figure 1:
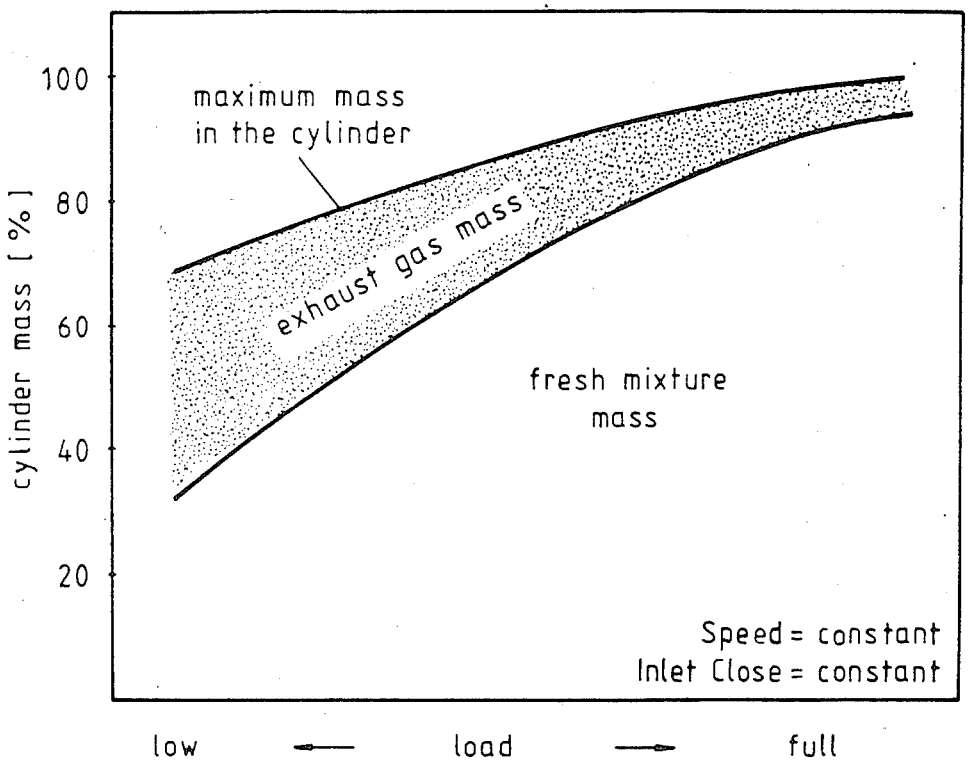
FIG. 1 shows the relation between fresh mixture mass and exhaust gas mass in the cylinder as a function of the load as achieved according to the invention.

FIG. 1 shows the method for load control according to the invention by means of exhaust gas. At full load the maximum amount of fresh mixture mass is in the cylinder. Fresh mixture mass together with a nonavoidable amount of exhaust gas determines the maximum mass in the cylinder. Starting at this full load the exhaust gas mass in the cylinder is increased to reduce the load. With increasing exhaust gas mass the temperature in the cylinder during the gas exchange cycle increases so the maximum mass in the cylinder decreases. Decreased maximum mass and increased exhaust gas mass in the cylinder tend for the available cylinder volume for receiving fresh mixture mass to be smaller so the fresh mixture mass decreases thereby reducing the load. As FIG. 1 shows, this method can be carried out with constant valve timing "Inlet Close" only by coordinating the valve timings "Inlet Open" and "Exhaust Close". In the event load control is desired in the whole engine area coordination of the openning and closing times of intake and exhaust valve is necessary.

Figure 2:
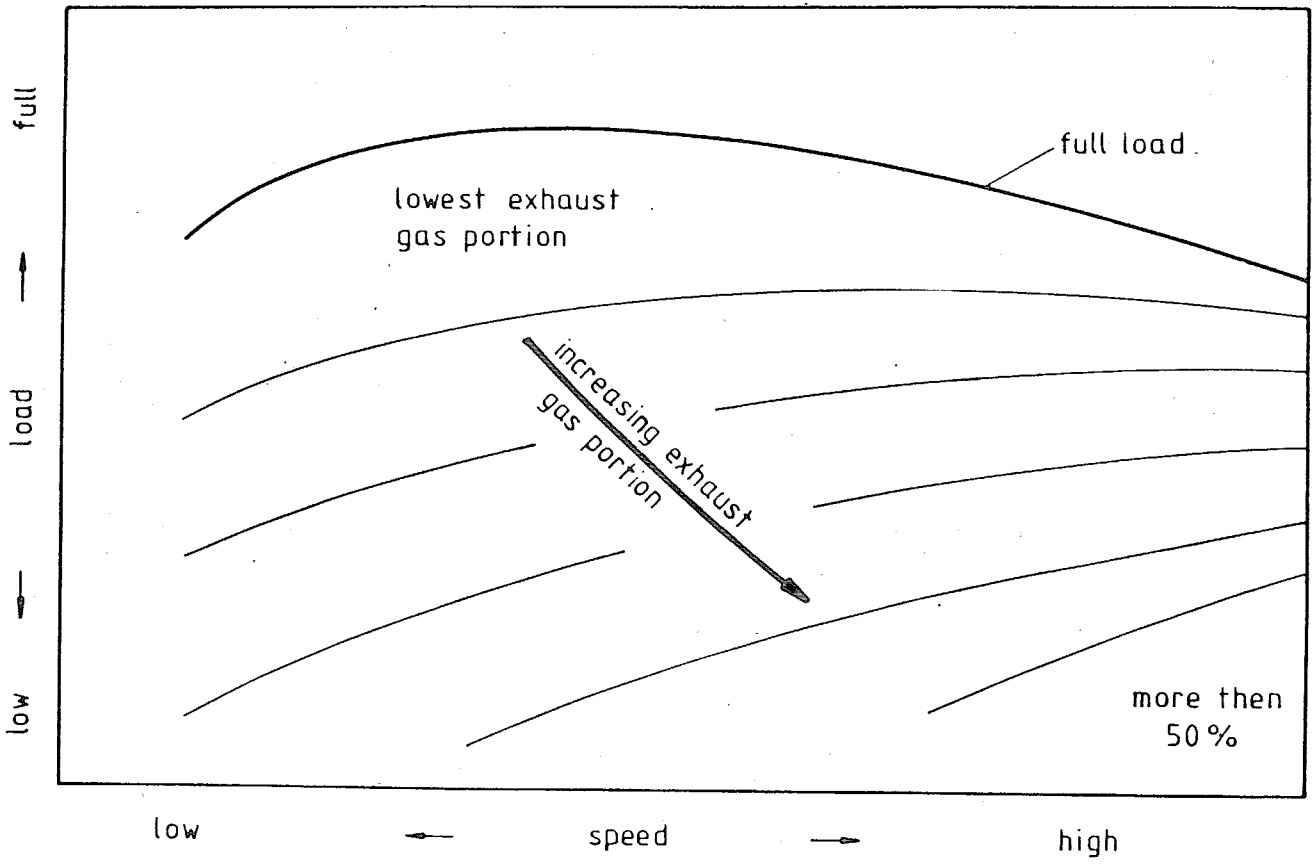
FIG. 2 shows the exhaust gas portion in the whole engine area necessary to achieve the load control desired according to the invention.

FIG. 2 shows how the amount of exhaust gas has to be changed in the whole engine area to fulfill the load control desired. Under full load operation, the lowest amount of exhaust gas remains in the cylinder. To reduce the load the amount of exhaust gas in the cylinder is increased to more than 50 percent under high speed conditions. Especially under low speed conditions it is necessary to coordinate the closing time of the inlet valve to the closing time of the exhaust valve and to the opening time of the inlet valve to achieve a good working load control.

Figure 3:
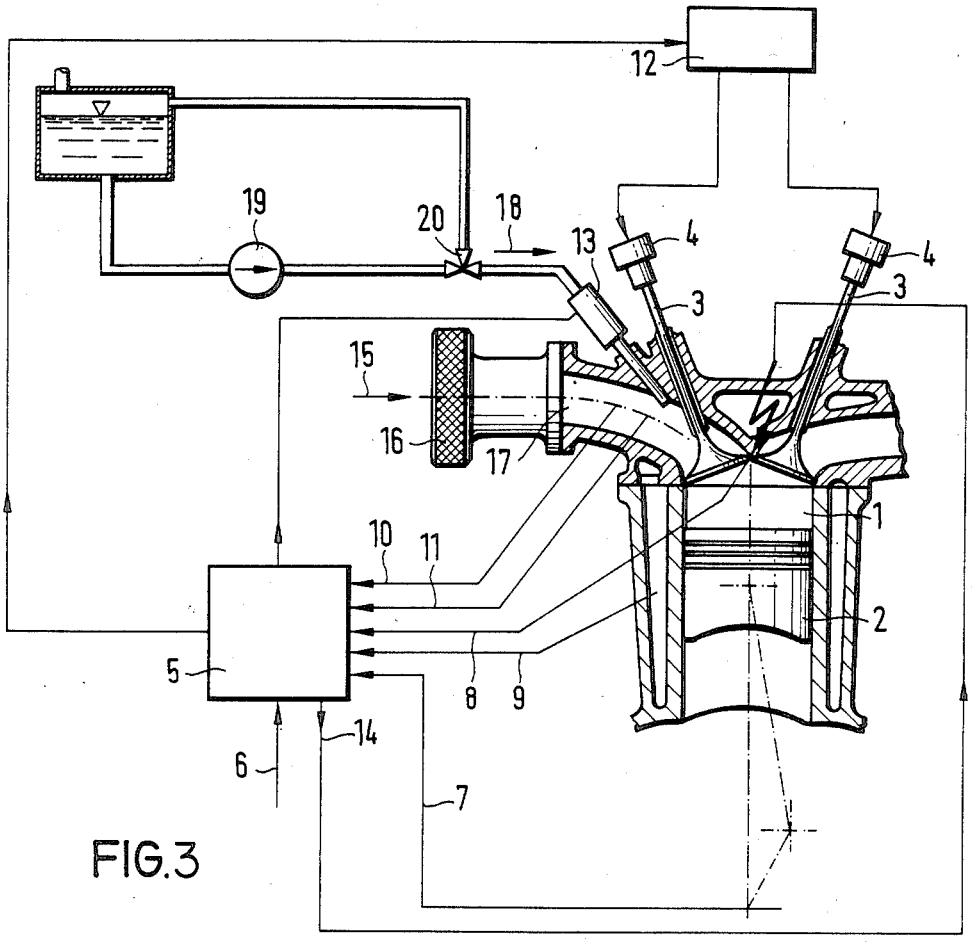
FIG. 3 shows a schematic partial section through the combustion chamber area of an internal combustion engine adapted for carrying out the method of the invention.

FIG. 3 schematically shows the area of the combustion chamber of an internal combustion engine having at least one cylinder tube 1 in which piston 2 is located. Valves 3 serve to control the internal combustion engine and are driven by variable valve controls 4. Characteristic engine diagrams for various operational states are stored in control logic unit 5 in the form of control times for controlling the inlet valve E and the outlet valve A as well as for controlling the fuel injection and ignition timing. The particular control logic is chosen on the basis of control input 6, rotational speed information 7, engine component temperatures 8, cooling water temperature 9, combustion air pressure 10 and combustion air temperature 11.

The particular control timing is transmitted to amplifier stage 12 for controlling valves 3 with the valve controls 4 which are constructed as known electromechanical transducers. The control timing is also transmitted to injection nozzle 13 which also may be constructed as an electro-mechanical transducers and to ignition system 14. Thus the control timing of the valves also regulates air flow 15 through filter 16 in inlet manifold 17 and the control timing of the injection nozzle 13 regulates fuel flow 18 from the fuel tank via pump 19 and pressure control valve 20.

Figure 4:
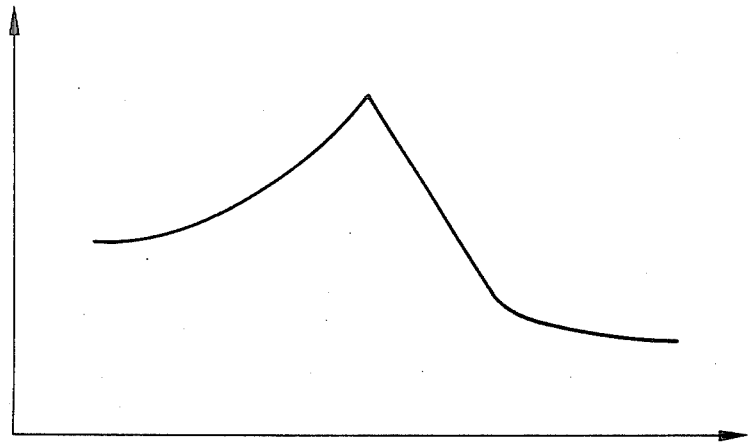
FIG. 4 shows a diagram depicting the amount of exhaust gas to be added to the cylinder charge as a function of the engine load.

As FIG. 4 shows, starting from a state of full engine load at any engine speed at which the exhaust gas remaining in the cylinder is held to a minimum by appropriate control timing of the inlet and outlet devices, the engine load can be reduced according to a preferred embodiment of the invention by increasing the exhaust gas in the cylinder. This is achieved by appropriately controlling the inlet and outlet devices so that the remaining cylinder volume available for taking in the fresh air and fuel mixture is decreased. The engine load is reduced by reducing the amount of the fresh air and fuel mixture taken in. This control procedure can be considered applicable up to engine operating conditions of approximately one half the maximum engine load.

Yet a further decrease of the engine load can be achieved in accordance with the invention by reducing the exhaust gas remaining in the combustion chamber from the preceding work cycle by appropriate control timing of the inlet and outlet devices in the area of the top dead center of the gas exchange cycle and decreasing the fresh fuel mixture arriving in the combustion chamber by appropriate control timing of the moment of inlet closing. FIG. 4 qualitatively shows the amount of the exhaust gas in the entire cylinder charge as a function of the engine load. The amount of exhaust gas desired for the following work cycle can be obtained from exhaust gas remaining in the combustion chamber and/or by taking in stored exhaust gas from the intake passage and/or by taking exhaust gas back from the exhaust line.

Figure 6:
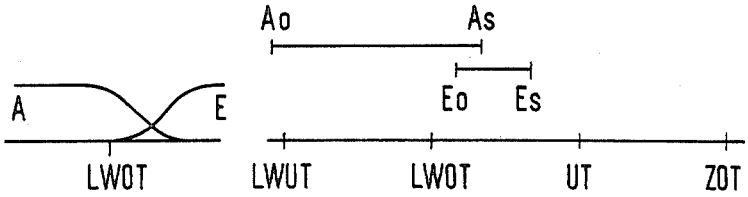
Figure 7:
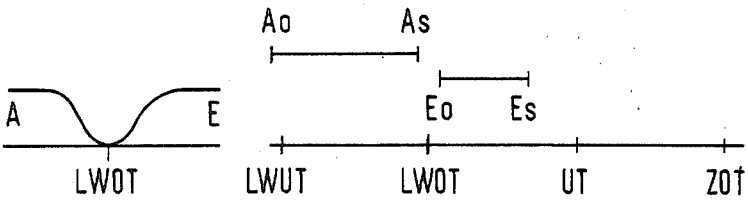
Figure 8:
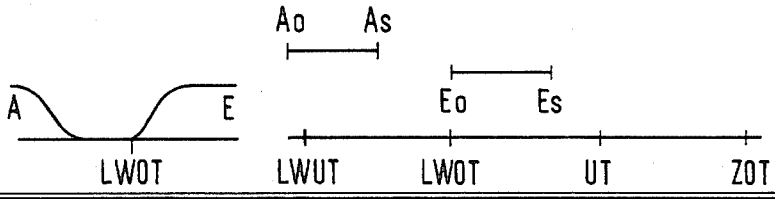
Figure 9:
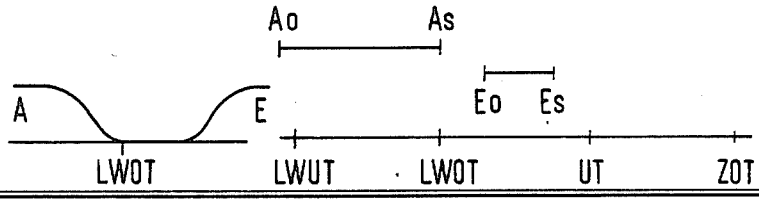
Figure 10:
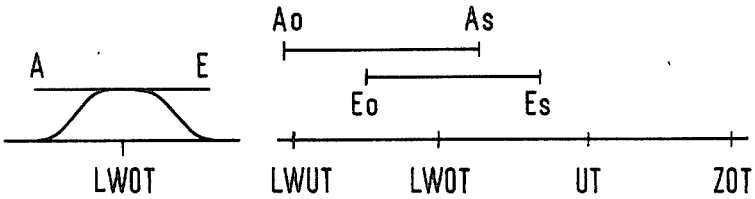

The left side of FIGS. 5 through 10 shows the stroke function of oulet valve A and of inlet valve E in the area of the top dead center, LWOT, of the gas exchange cycle. The right side of FIGS. 8 through 10 shows the opening times of the valves represented by timing lines disposed over and correlated with the crank angle position shown as a base line. Ao represents the opening time of the outlet valve and As the closing time of the outlet valve A. Eo indicates the opening time of the inlet valve and Es indicates the closing time of the inlet valve. The base line of the right diagrams in FIGS. 5 through 10 extends from the bottom dead center, LWUT, of the piston at the start of the gas exchange cycle to the top dead center, ZOT, of the ignition. The inlet valve E closes before the bottom dead center UT at the end of the gas exchange cycle to indicate the performance control process of an "early inlet closure" which is used to limit the fresh air and fuel mixture taken into the cylinder.

FIGS. 11 through 20 show the sequence or progression of pressure in the pressure-volume diagram of an internal combustion engine in the area of the gas exchange cycle in order to explain in more detail the method of the invention. In these figures $p_u$ represents the atmospheric pressure and OT indicates the top dead center position of an exhaust cycle.

Figure 5:
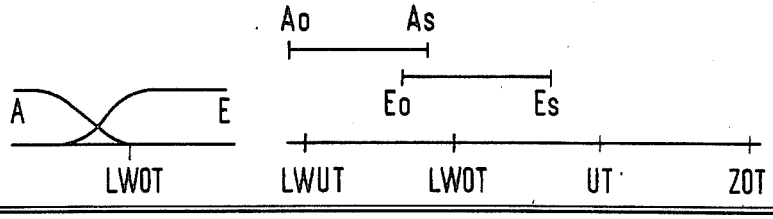
FIGS. 5 to 10 show control diagrams of valve stroke functions of preferred embodiments on the left side of each Figure and control diagrams of preferred embodiments of opening times of the valves on the right side of each Figure as a function of engine crank angle position.
Figure 11:
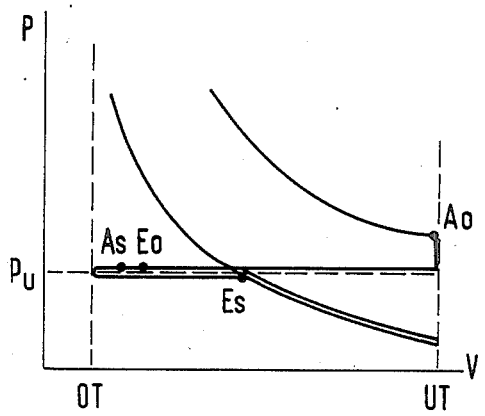
FIGS. 11 to 20 graph the progression of cylinder pressure in the pressure-volume diagram of an internal combustion engine during the gas exchange process.
Figure 12:
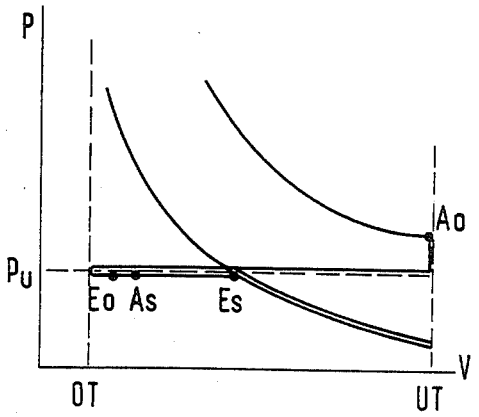
Figure 13:
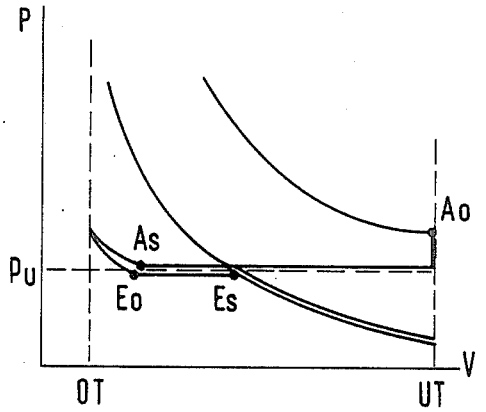
Figure 14:
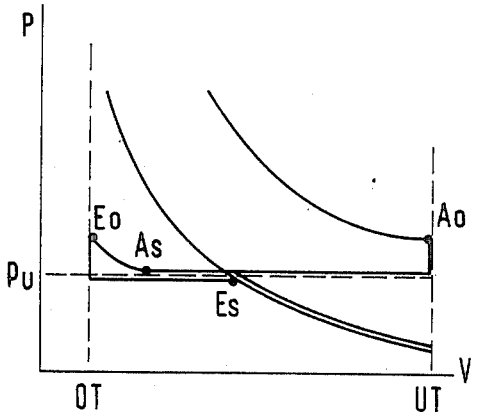

In conjunction with appropriate control times for opening the inlet device, metered fresh exhaust gas from a preceding work cycle can be pushed briefly into the cylinder inlet line or into the cylinder outlet line and taken in again in combination with an early closing of the outlet device as represented in FIGS. 5 and 11 or in combination with a late closing of the outlet device as represented in FIGS. 6 and 12. In this manner, a part of the piston stroke is used first for a metered filling of the work chamber cylinder with exhaust gas and then a subsequent part of the piston stroke is used for filling the cylinder with a fresh air and fuel mixture. The cylinder contents thereby include hot fresh exhaust gas and a fresh air and fuel mixture which mix together during the subsequent cylinder compression cycle. An analogous effect can also be obtained by closing the cylinder outlet early and opening the cylinder inlet late, relative to the top dead center position as shown in FIGS. 7 and 13. This makes it possible to raise the compression ratio in the cylinder at a given fresh air and fuel mixture level for a partial load and at the same time to make use of the advantageous influence of the still reactive exhaust gases on the ignition and on the flame propagation.

It is possible in another embodiment of the invention to allow the outlet valve to close before the piston reaches the top dead center position of the exhaust stroke, so that compressed exhaust gas is maintained in the cylinder during the last travel section of the piston exhaust stroke. If the inlet valve is opened around the top dead center of the exhaust stroke, the exhaust gas will flow into the inlet line under the influence of the pressure drop between the inlet line and the cylinder, which will sharply intensify the formation of the fuel mixture in the inlet line. The mixture of exhaust gas and fresh air and fuel charge formed in this manner in the inlet line is taken into the cylinder until the inlet valve closes as graphically depicted in FIGS. 8 and 14.

Figure 15:
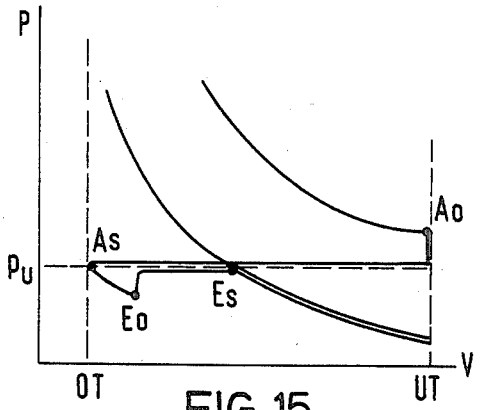
Figure 16:
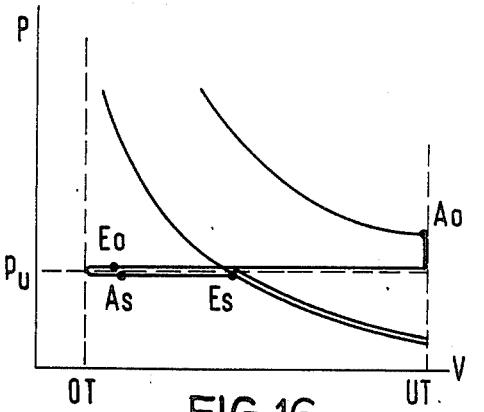

The mixing formation of the fuel mixture can also be intensified if the outlet valve closes near the top dead center of the exhaust stroke and if the inlet valve does not open until a later time after a certain predetermined degree of piston travel. The vacuum in the cylinder produces an intensive inflow of fresh air and fuel into the cylinder upon opening of the inlet valve which intensifies the mixing formation of charge mixture. Such timing is schematically represented in FIGS. 9 and 15. It is also possible to close the outlet valve after the top dead center of the exhaust stroke in order to increase the amount of exhaust gas in the above case, whereby the opening of the inlet valve is shifted to a corresponding later time. It can also be advantageous at special engine operating levels to first push exhaust gas into both inlet and outlet lines by a sharp overlapping of inlet and outlet openings in the upper area of the piston travel and to take it in again during the downward travel of the piston as shown in FIGS. 10 and 16.

It is advantageous in the application of the invention to proceed according to FIGS. 13 and 15 together with FIGS. 8 and 9 in such a manner that a pressure difference is formed between the combustion chamber and the inlet line or the exhaust gas line by appropriate control timing and so rapidly reducing such pressure difference at the subsequent opening of the inlet or outlet device that an improvement in the preparation of the charge mixture occurs as a result of turbulence. Also it is advantageous to create a pressure differential between the exhaust line and the combustion chamber by early closing of the outlet device while maintaining the inlet device closed and subsequent rapidly opening the exhaust device to generate turbulence within the combustion chamber.

As can be seen in FIG. 11 together with FIG. 5, a preferred embodiment of the invention pushes an amount of exhaust gas into the inlet line by appropriate control timing of the opening duration of the inlet opening time and the closing duration of outlet closing time before the top dead center of the gas exchange. It can be advantageous according to the representation in FIG. 12 together with FIG. 6 if an amount of exhaust gas is taken in from the outlet line by appropriate control timing of the inlet opening and outlet closing durations after the top dead center of the gas exchange.

FIG. 13 shows together with FIG. 7 that an amount of exhaust gas remains in the combustion chamber by appropriate duration control times for the outlet closings before the top dead center of the gas exchange and for the inlet openings after the top dead center of the gas exchange. It can also be advantageous if in accordance with FIG. 16 together with FIG. 10 exhaust gas is pushed into the intake line as a result of control duration times for effecting in an early inlet opening before the top dead center of the gas exchange and then is taken in again and if additional exhaust gas is taken back in from the outlet line by a late outlet closing after the top dead center of the gas exchange.

It is desirable to calculate the amounts of exhaust gas in such a manner that, starting from a full load, the percentage of exhaust gas in the cylinder charge increases as the load decreases and in the area of a small load the percentage of exhaust gas decreases again as represented in FIG. 4.

Another preferred embodiment of the invention provides that when the set maximum speed of engine revolution is reached, the control times for the inlet device and the outlet device are selected for purposes of limiting the speed of rotation in such a manner that the torque, starting from a full load value, drops to lower values if the speed of rotation increases slightly above the maximum speed. This makes possible a smooth regulation of the load for an even driving operation at the limit of the speed of rotation. This also enables an engine operation which is thrifty and low in toxic substances. This result is quite different from that of previous ignition cutoff control methods which resulted in an erratic and jerky operation at the regulating speed limit, a high fuel consumption and a high emission of toxic substances.

The invention also provides that if the engine speed falls below a set idling speed, the cylinder charge is increased by appropriately coordinated control times for the inlet and the outlet devices in order to stabilize the idling. This makes it possible to stabilize the idling behavior under all operating conditions. Such a procedure was not known previously, since a modification of the throttle valve was previously necessary and the stabilizing of the idling was previously performed by enriching the mixture. That method naturally resulted in high fuel consumption and a high emission of toxic substances.

It can be advantageous in an overrun condition to keep the gas exchange losses low by keeping the inlet and outlet devices open and/or closed, for example, when the engine is being driven by its load during braking. This has the result that the engine has particularly low losses in overrun. The fuel consumption is zero and there is no emission of toxic substances. Such a result was not obtainable up to the present, since a difficult modification of dynamically highly stressed valve drives would have been required. Thus, earlier conventional operating modes resulted in considerably greater inclusion of the overrun output, undesirably high emissions of toxic substances due to incomplete combustion of fuel and also resulted in fuel being swept through with ignition cutoff.

Figure 18:
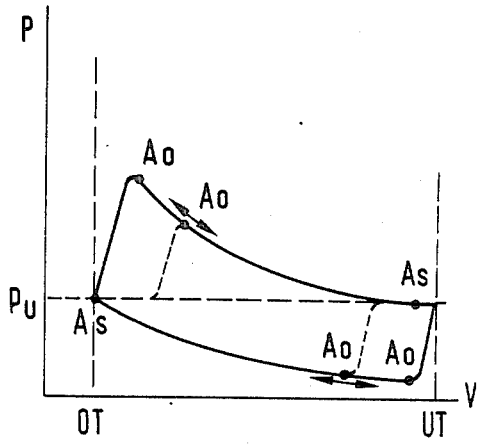

As FIG. 18 shows, the outlet device can be controlled during engine braking with the inlet device held closed in such a manner that the work involved in changing the volume of the cylinder contents is increased by opening the outlet device when pressure differences exist between the work chamber and the exhaust gas system. While in usual methods of engine braking by exhausting under elevated counterpressure of the exhaust gas braking work can only be achieved in one stroke in a four-stroke operation, it is possible according to the invention to use every upward movement of the piston for a compression stroke and every downward movement of the piston for an expansion stroke, thus reducing the existing energy via energy discharge for the purpose of braking. This makes it possible to obtain a braking output which is considerably greater than that of previous engine braking methods.

Figure 17:
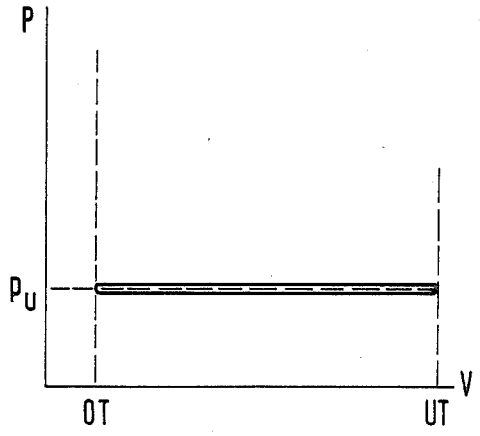
Figure 19:
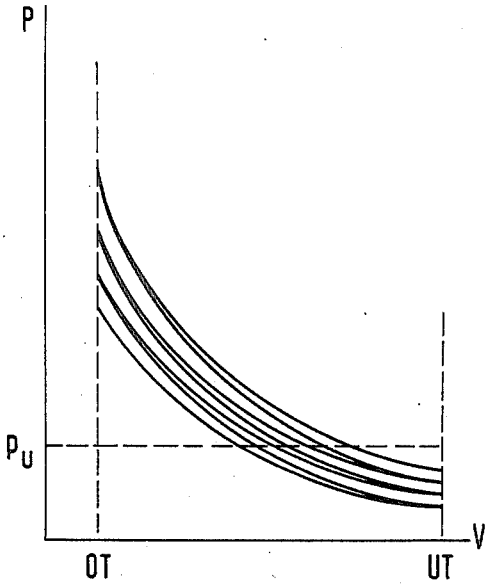

In order to improve engine starting, the required amount of fresh air and fuel mixture can be taken in according to FIG. 19 by appropriately controlling the inlet valve and delaying ignition until after a few compression and expansion strokes have taken place with the inlet and outlet valves kept closed in order to achieve a better preparation of the mixture. Alternatively, a better preparation of the mixture can be achieved by pushing the fresh air and fuel mixture back and forth between the intake line and the combustion chamber with the inlet valve held open, as FIG. 17 shows.

Figure 20:
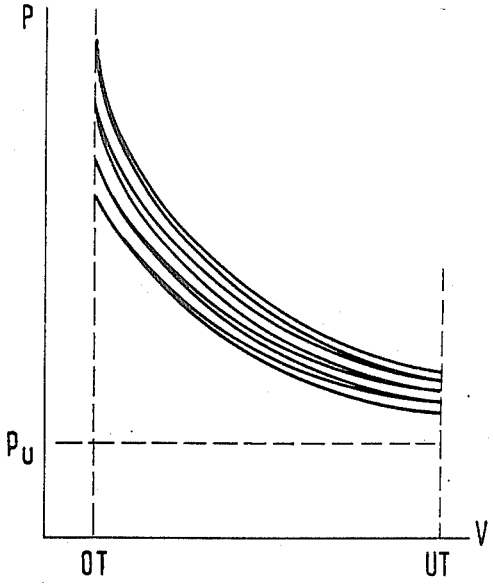

It can also be advantageous in certain instances in order to improve engine warm-up, if the exhaust gas present in the combustion chamber after a work stroke remains either entirely or partially in the cylinder by appropriately controlling the outlet valve which brings about a rapid heating of the engine during compression and expansion by giving off the residual combustion heat to the surface of the combustion chamber, as FIG. 20 shows.

One or several cylinders can be put out of operation by appropriately controlling the inlet and outlet devices, such that the inlet devices are kept closed and the combustion chamber temperature is maintained by exhaust gas taken back in through the outlet device, which is kept open.

As can be seen from the arrangement shown in FIG. 3, the metering of fuel in an internal combustion engine can be set as a function of the speed of rotation and the valve control timing in connection with the pressure and temperature in the intake manifold so that the fuel flow to be injected can be determined for a required air fuel ratio $\lambda$ without an additional air measuring device. This procedure has the advantage that a special fuel metering system is not needed. Additional fuel metering systems require much space and necessitate additional expense.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A method for load control of an internal combustion four-stroke engine wherein the load of the engine is controlled by the amount of fresh air and fuel supplied to the combustion chamber, the engine having at least one combustion chamber provided with intake means together with an intake line having invariable flow area dimensions outside said intake means, and exhaust means together with an exhaust line having invariable flow area dimensions outside said exhaust means by which both the opening and closing times of the inlet and exhaust means are adjustable entirely independently from each other and from the crank position, and wherein the method comprises; for the purpose of load control, indirectly controlling the amount of fresh air and fuel supplied to the combustion chamber by retaining a predetermined amount of exhaust gas in the combustion chamber after completion of the charge exchange cycle so as to reduce available combustion chamber volume for receiving said amount of fresh air and fuel during the induction process, the amount of fresh air and fuel and the amount of exhaust gas being exclusively controlled by coordinating the opening and closing times of the intake means with the opening and closing times of the exhaust means.

2. The method of claim 1, wherein said controlling further comprises forming a pressure differential between said combustion chamber and said intake line and rapidly reducing said pressure differential by opening said intake means to generate turbulence so as to improve mixing of said fresh air and fuel mixture.

3. The method of claim 1, wherein said controlling further comprises forming a pressure differential between said combustion chamber and said exhaust line and rapidly reducing said pressure differential by opening said exhaust means to generate turbulence within said combustion chamber so as to improve mixing of said fresh air and fuel mixture.

4. The method of claim 1, wherein during engine braking, said coordinating further comprises closing said intake means such that work associated with changing the volume of contents within said combustion chamber is increased by opening said exhaust means upon presence of a pressure differential between said combustion chamber and said exhaust line during said exhaust cycle.

5. The method of claim 1, wherein said controlling further comprises cycling said fresh air and fuel mixture back and forth a plurality of times between said intake line and said combustion chamber with said intake means open so as to improve preparation of said fresh air and fuel mixture for combustion.

6. The method of claim 1, wherein said controlling further comprises compressing and expanding said fresh air and fuel mixture a plurality of times by maintaining said intake means and said exhaust means closed before combustion is initiated so as to improve preparation of said fresh air and fuel mixture for combustion.

7. The method of claim 1, wherein said controlling further comprises cycling said exhaust gas back and forth a plurality of times between said exhaust line and said combustion chamber with said exhaust means open so as to improve heating up said combustion chamber.

8. The method of claim 1, wherein said controlling further comprises retaining said exhaust gas partially within said combustion chamber after at least one work stroke and during at least one compression and expansion stroke.

9. The method of claim 1, wherein said controlling further comprises retaining said exhaust gas completely within said combustion chamber after at least one work stroke and during at least one compression and expansion stroke.

10. The method of claim 1, wherein said controlling further comprises increasing a percentage of said exhaust gas in said combustion chamber as engine load decreases from full load and decreasing said percentage of said exhaust gas in said combsution chamber as engine load approaches a small load.

* * * * *